US007552691B1

(12) United States Patent
Martelli et al.

(10) Patent No.: US 7,552,691 B1
(45) Date of Patent: Jun. 30, 2009

(54) SUPPORT AND CASSETTE APPARATUS AND METHOD

(75) Inventors: John D. Martelli, Pensacola, FL (US); Stuart Simons, Pensacola, FL (US)

(73) Assignee: Martelli Enterprises, Inc., Pensacola, FL (US)

( * ) Notice: Subject to any disclaimer, the term of this patent is extended or adjusted under 35 U.S.C. 154(b) by 0 days.

(21) Appl. No.: 11/543,453

(22) Filed: Oct. 5, 2006

(51) Int. Cl.
*D05B 11/00* (2006.01)
*D05B 23/00* (2006.01)

(52) U.S. Cl. ..... 112/475.08; 112/117; 112/470.12

(58) Field of Classification Search ..... 112/117, 112/118, 119, 98, 470.12, 470.13, 475.01, 112/220, 475.08
See application file for complete search history.

(56) References Cited

U.S. PATENT DOCUMENTS 2,274,508 A * 2/1942 Thompson et al. ..... 112/11
3,083,654 A * 4/1963 Cash, Sr. ..... 112/2.1
4,192,241 A * 3/1980 Reed et al. ..... 112/117
4,470,361 A * 9/1984 Smith ..... 112/470.12
4,494,431 A * 1/1985 Niswonger ..... 83/471.3
4,958,544 A * 9/1990 Miyamoto ..... 83/471.3
5,103,747 A * 4/1992 Resta et al. ..... 112/117
5,145,144 A * 9/1992 Resta et al. ..... 248/637
5,287,820 A * 2/1994 Stutznacker ..... 112/117
5,322,027 A * 6/1994 Hashiride et al. ..... 112/220
5,333,561 A * 8/1994 Katou ..... 112/470.13
5,540,165 A * 7/1996 Katou et al. ..... 112/470.13
5,642,679 A * 7/1997 Monget et al. ..... 112/470.13
5,711,236 A * 1/1998 Badger ..... 112/117
6,079,341 A * 6/2000 Resta ..... 112/117
6,631,688 B1 * 10/2003 Maag ..... 112/118
6,932,007 B1 * 8/2005 Beauchamp ..... 112/117
7,191,718 B1 * 3/2007 Myers et al. ..... 112/117

* cited by examiner

*Primary Examiner*—Ismael Izaguirre
(74) *Attorney, Agent, or Firm*—J. Nevin Shaffer, Jr.

(57) ABSTRACT

In a quilting system, a support and cassette apparatus includes a support with a cassette movably connected with the support such that the cassette captures the support within the cassette. A carriage is attached to the cassette.

20 Claims, 4 Drawing Sheets

SUPPORT AND CASSETTE APPARATUS AND METHOD

FIELD OF THE INVENTION

This invention relates to a support and cassette apparatus and method. In particular, in accordance with one embodiment, the invention relates, in a quilting system, to a support and cassette apparatus including a support with a cassette movably connected with the support such that the cassette captures the support within the cassette. A carriage is attached to the cassette.

BACKGROUND OF THE INVENTION

The prior art is replete with devices designed to make work easier for those involved. By way of example only and not by limitation, the task of creating a quilt is one that has evolved a certain standard set of tools and equipment. A major requirement, of course, is the support and movement of a sewing device. Applicant is aware of the state of the prior art that has for a long time remain unchanged. Currently, the sewing device is supported by a movable carriage that runs along a pair of oppositely positioned rails. The wheels of the carriage ride on the rails or sometimes in grooves in the rails. These prior art devices rely on gravity to hold the wheels to the rails or tracks. The carriage and rails of the prior art system are located at or below waist height. Thus, handles attached to the top of the sewing machine, which is attached to the carriage, for moving the carriage extend upward from the sewing machine and add side to side loading to the carriage as it is moved. Any loading of these prior art carriages in any direction other than down causes a moment to be created between where the handles are and where the wheels are. Thus there is a tendency for these prior art devices, particularly larger ones, to tip as the carriage is moved side to side. Additionally, the force required to move and change direction of the prior art carriages tends to tire the operators and, in some cases, cause the user's shoulders to actually ache after extended periods of operation making for bad ergonomics.

Further drawbacks to the accepted prior art systems are found in the use of patterns. Currently, when an operator wishes to trace a pattern she must go around the back of the machine and place a stencil or pattern on a table under the machine and line up her pointer with the pattern. The pattern is placed off to the left or right of the machine in an upside down orientation so that the operator must gaze down and to the left while operating the prior art machine backwards. This can cause back aches, eye strain and some people simply can't master the required motions. It is similar to driving a car while sitting in the passenger seat and looking only at the passenger side dashboard.

Thus, there is a need in the art of quilting and the like, for example only, for a carriage system that is easy to manipulate without fatigue and that does not introduce tipping motions to the sewing device. Further, there is a need in the art for a carriage system that enables an operator to easily and instinctively trace a pattern.

SUMMARY OF THE INVENTION

Accordingly, the support and cassette apparatus and method of the present invention according to one embodiment includes in a quilting system, a support. A cassette is movably connected with the support such that the cassette captures the support within the cassette and a carriage is attached to the cassette.

According to another aspect of the invention, the support is a monorail. In another aspect, the cassette includes rollers. In a further aspect, the cassette includes vertical rollers and horizontal rollers. In one aspect of the invention, the support includes at least one rail captured by the cassette. In another aspect, at least one handle is attached to the carriage approximately even with the support. In a further aspect, a pattern table is added to the system approximately even with the support. In one aspect, the pattern table includes a pattern guide for tracing a pattern on the pattern table. In a further aspect the pattern guide is selected from a group comprising: a computer graphic, a LED light and a laser light.

According to another embodiment of the invention, in a quilting system, a support and cassette apparatus includes an elevated monorail support. A cassette is movably connected with the elevated monorail support such that the cassette captures the elevated monorail support within the cassette. A carriage is movably attached to the cassette.

In accordance with one aspect of this invention, the cassette includes vertical rollers and horizontal rollers. In a further aspect, the support includes at least one rail captured by the cassette. In another aspect, at least one handle is attached to the cassette approximately even with the elevated monorail support. In another aspect, a pattern table is attached approximately even with the elevated monorail support. In a further aspect, the pattern table includes a pattern guide for tracing a pattern on the pattern table. In accordance with one aspect, the carriage supports a sewing device from below the sewing device. In a further aspect, the carriage supports a sewing device from above the sewing device.

According to another embodiment of the invention, in a quilting system including a monorail and a cassette, a method for quilting includes the steps of providing a quilting system with a support with a cassette movably connected with the support such that the cassette captures the support within the cassette, with a carriage movably attached to the cassette and with a sewing device attached to the carriage; inserting material to be quilted into said quilting system; and manipulating said carriage and operating said sewing device so as to create a quilt from said quilting material.

According to another aspect, the method includes the step of attaching a pattern table approximately even with the elevated monorail support. Another aspect includes the step of placing a pattern on the pattern table and tracing the pattern by moving the carriage so as to follow the pattern.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
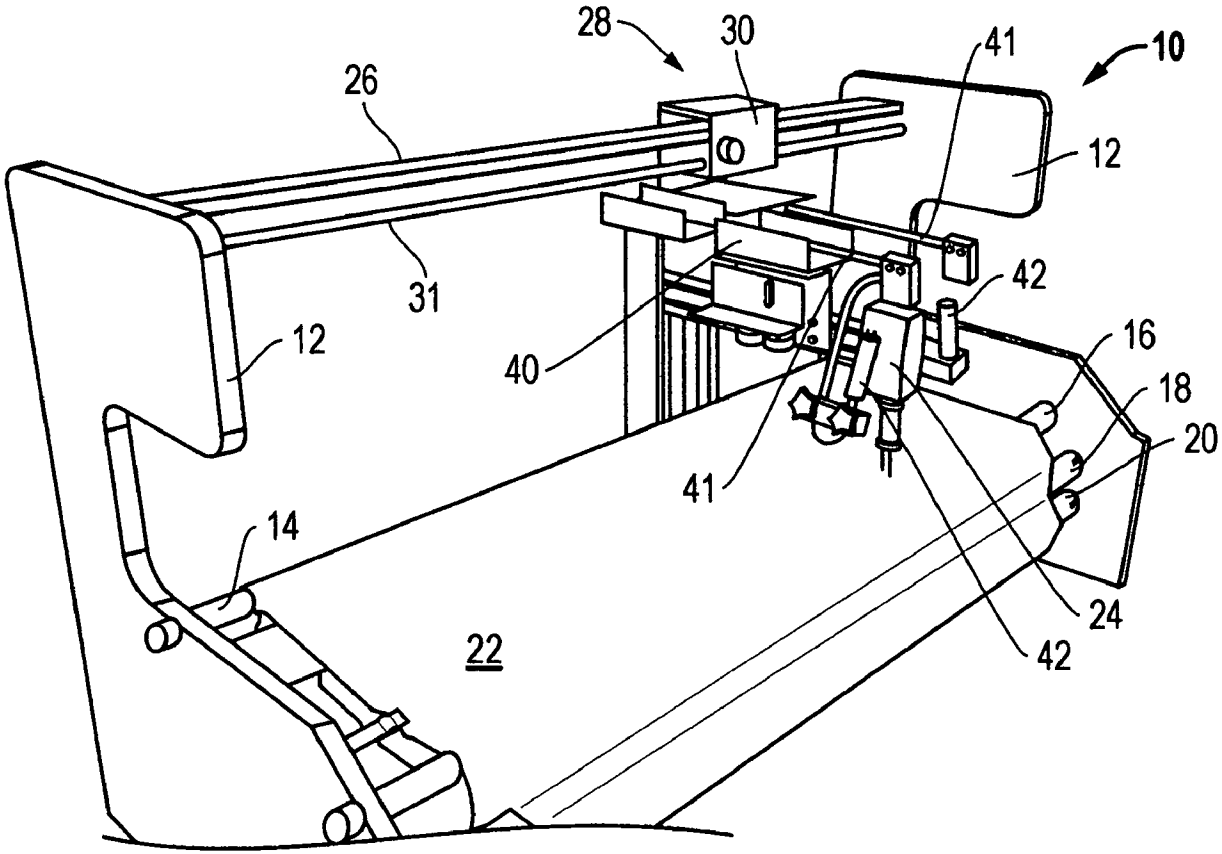
FIG. 1 is a perspective view of the support and cassette apparatus of the present invention according to one embodiment showing a sewing device supported from above by a carriage.

The preferred embodiment of the present invention is illustrated by way of example in FIGS. 1-4. With specific reference to FIGS. 1, 2 and 3, the support and cassette apparatus 10 of the present invention, according to one embodiment, includes, in a quilting system for example only and not limitation, a quilting system frame 12. Quilting system frame 12 includes, for example only and not by limitation, take up roll 14, idler roll 16, first feed roll 18 and second feed roll 20. Quilting material 22 is pulled from first feed roll 18 and second feed roll 20 over idler roll 16 where the quilting design is added by means of sewing device 24 and the quilting material 22 with a design is then rolled onto take up roll 14, all as known in the art.

Figure 2:
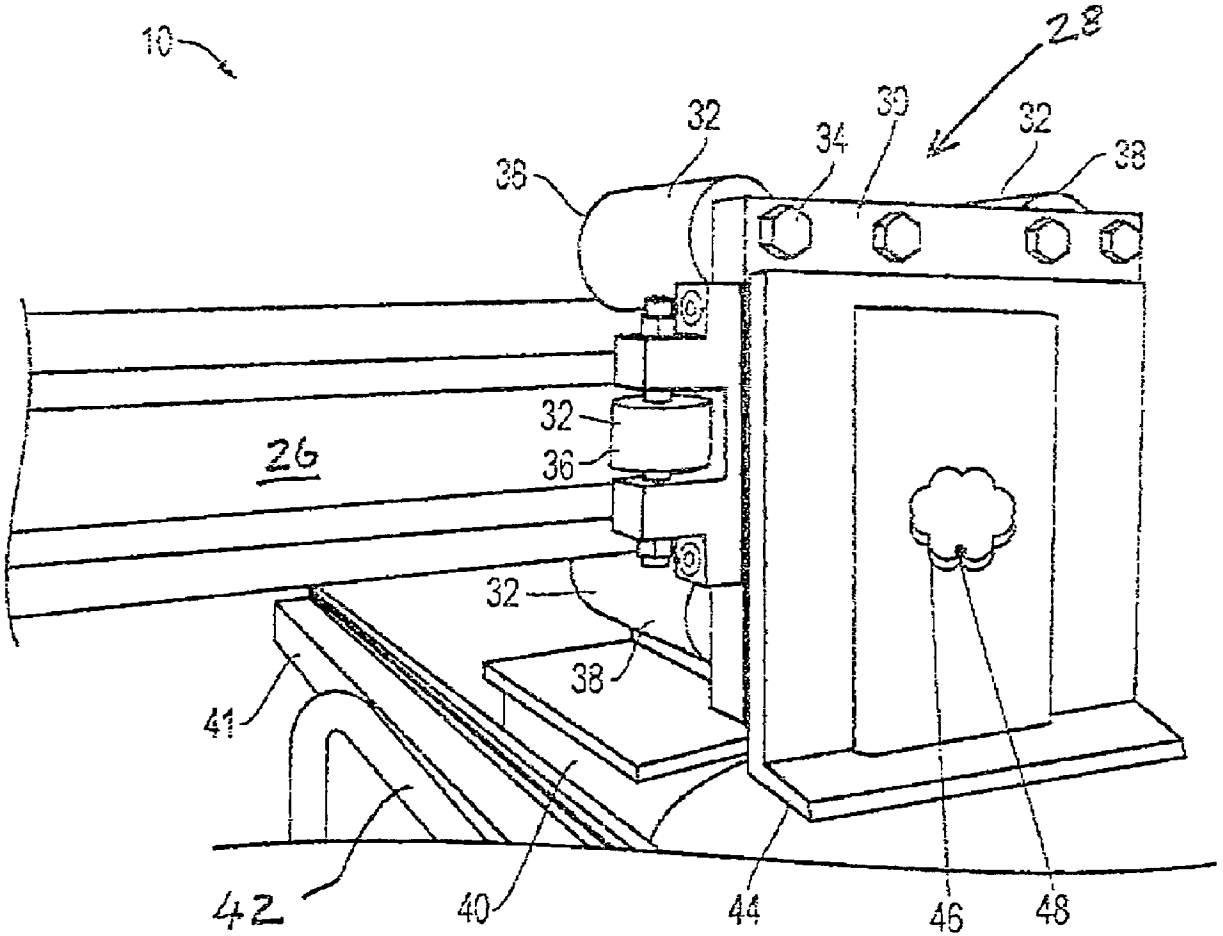
FIG. 2 is a perspective view of the invention of FIG. 1 showing horizontal and vertical rollers and a pattern table with a pattern.

FIGS. 1 and 2 also illustrate support 26. As illustrated, support 26 is a uniform rectangularly shaped monorail. Obviously, support 26 may be any size and dimension and may be made of any useful material. Light weight aluminum is preferred. Further, support 26 may be formed from a pair or more of supports joined together or separated. Importantly, support 26 is preferably suspended from quilting system frame 12 in an "elevated" position. As used herein, the term "elevated position" is used to describe a position waist high and higher with regard to a user. By comparison, prior art supports for sewing device 24 are at or below waist height in a "low" or "un-elevated" position. Preferably, support 26 is elevated to a position at or near the user's head and eyes.

Figure 3:
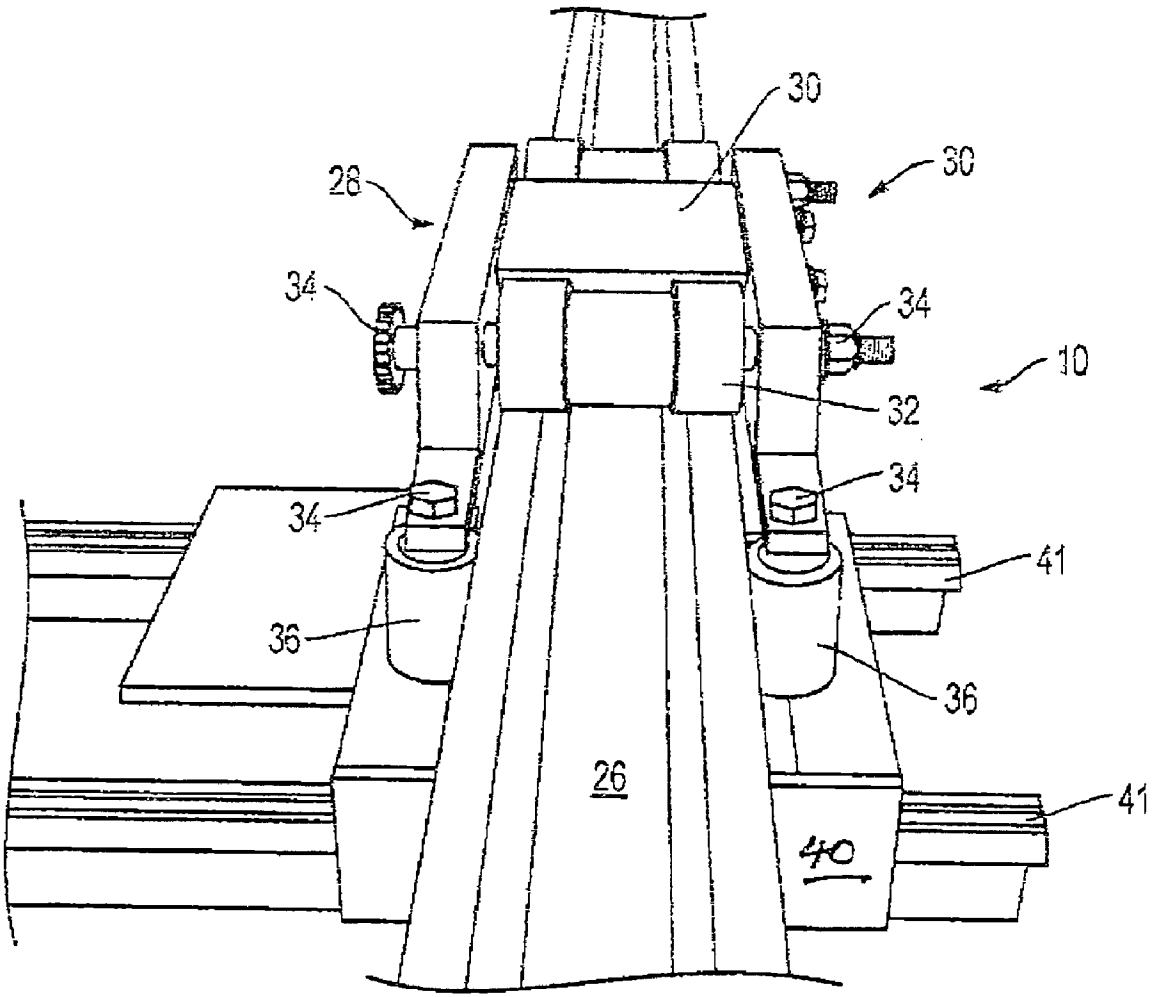
FIG. 3 is an end perspective view of the invention of FIG. 1 also showing horizontal and vertical rollers.

FIGS. 1, 2, and 3 also illustrate cassette 28. Cassette 28 is movably attached to and captures support 26. As used herein the term "captures" means that cassette 28 at least partially surrounds support 26 or some part of support 26. Preferably, cassette 28 includes four sides 30 that are joined together to form a box that surrounds support 26 on all four sides of the support 26. Obviously, cassette 28 may be conformed to adequately "capture" support 26 with less than four sides 30 as with three sides or one complete side and two partial sides 30 or the like and still meet the requirements of the invention. Cassette 28 captures support 26 within cassette 28 when some or all of the sides 30 encompass support 26 such that cassette 28 is securely and moveably connected with support 26.

The requirement that the cassette 28 move along support 26 may be satisfied by any means now known or hereafter developed. Preferably, support 26 includes at least one tubular rail 31 captured by cassette 28 as illustrated in FIG. 1. Cassette 28 slides easily along rail 31. Other means for moving cassette 28 smoothly and easily, includes rollers 32 attached to cassette 28 as shown in FIGS. 2 and 3. Rollers 32, again, like rail 31 enable the smooth movement of cassette 28 along the length of support 26. Rollers 32 may be made of any useful material, metal, rubber, plastic or the like, that are conformed to contact support 26 and rotate in response to pressure applied to cassette 28. Rollers 32 may be attached to cassette 28 by bolt and lock nuts 34, set screws, or any other means now known or hereafter developed that adjustably connect rollers 32 in the desired location with cassette 28 and that may be adjusted in or out or up and down as needed so as to allow rollers 32 to rotate freely.

As illustrated in the figures, preferably cassette 28 includes vertical rollers 36 and horizontal rollers 38 in the preferred number of four vertical rollers 36 and four horizontal rollers 38.

Still referring to FIGS. 1 and 2, carriage 40 is shown movably connected to cassette 28. FIG. 1 shows carriage 40 connected to cassette 28 and to the top of sewing device 24 such that, according to this embodiment, sewing device 24 is supported from above. Carriage 40 is connected to cassette 28 and therefore is capable of moving side to side along support 26. Additionally, carriage 40 is conformed to also move transversely to support 26 or "in and out" on in and out rails 41. The combination of side to side and in and out motion of the carriage 40 enables a user to direct sewing device 24 in the creation of any desired pattern or design as will be discussed more fully hereafter.

FIG. 1 shows that at least one and preferably two handles 42 are attached to the carriage 40 approximately even with the support 26 meaning in the same approximate plane. This feature reduces the moment arm common in prior art devices and reduces the effort and, therefore, the fatigue involved in using the invention.

Referring to FIG. 2, pattern table 44 is shown in place at approximately eye level directly in front of a user. Importantly, the pattern table 44 of the present invention does not require the user to abandon the normal position for creating quilts as with the prior art. Instead, when a pattern is to be used to create a design, the user simply places a pattern 46 on pattern table 44 and grasps handles 42. Preferably, pattern table 44 includes a pattern guide 48 that when activated represents the position of the sewing device 24 on the quilt with regard to the position of the pattern guide 48 to the pattern 46. Pattern guide 48 may be a computer graphic, a LED light or a laser light, for example only and not by way of limitation. The operation of such indicators is within the level of those of ordinary skill in the art and not discussed further herein. Suffice it to say that the movement of pattern guide 48 corresponds to the movement of sewing device 24 such that tracing the pattern 46 with pattern guide 48 while operating sewing device 24 results in the creation of a quilt with the same pattern 46.

Figure 4:
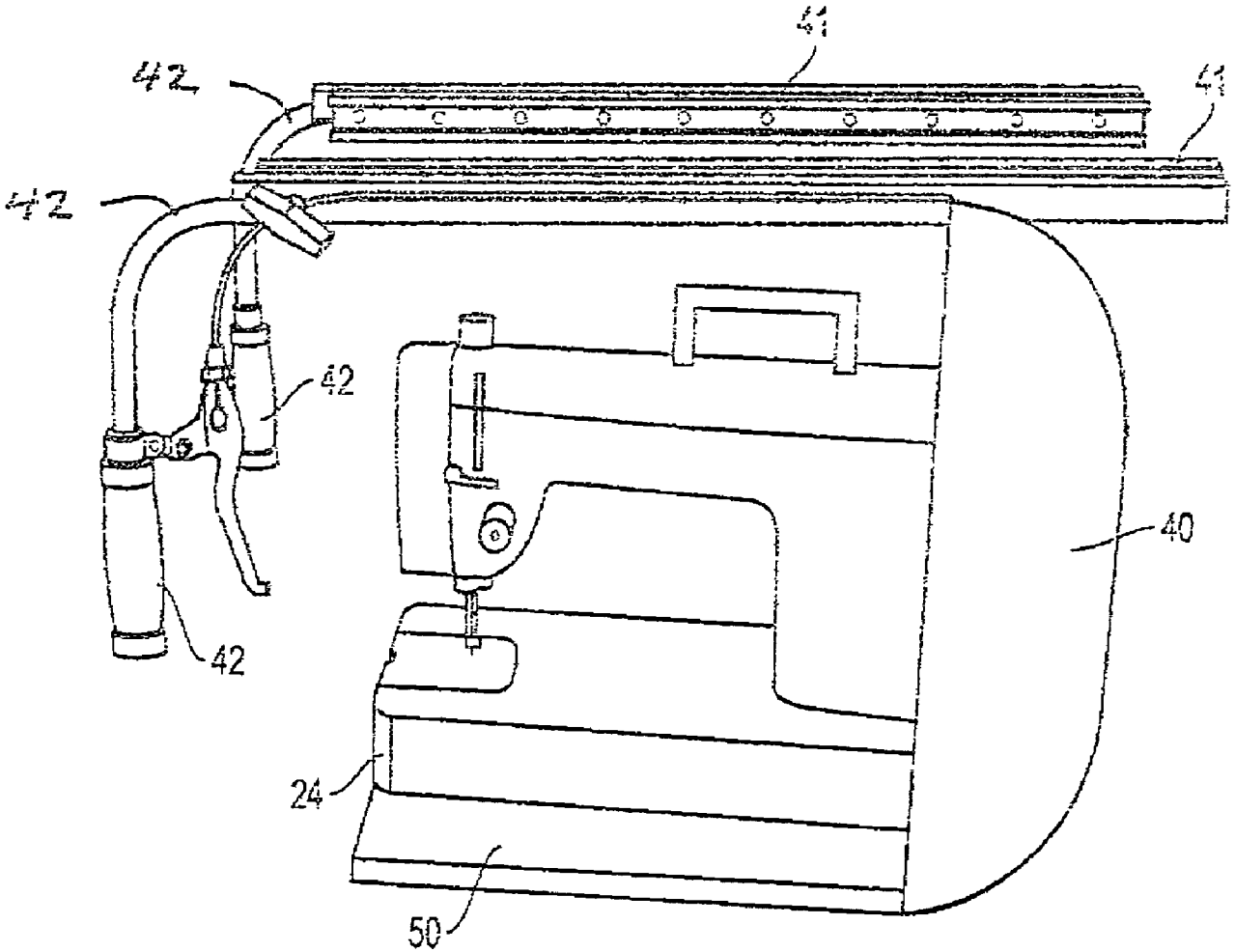
FIG. 4 is a side view of a carriage according to one embodiment for supporting a sewing device from below.

Referring now to FIG. 4, a side view of another embodiment of carriage 40 is shown with a sewing device 24 supported from below the sewing device 24. In this embodiment, carriage 40 is connected to cassette 28 as described above but carriage 40 includes platform 50. Platform 50 supports sewing device 24 from below while still enabling sewing device to be manipulated in and out on in and out rails 41 and side to side along support 26 as described above.

By way of further explanation, the support and cassette apparatus and method 10 of the present invention includes a cassette 28 that captures support 26, preferably a monorail, along each face of the support 26 or captures rails 31 thereby effectively eliminating any tipping tendencies common in the prior art. Further, because handles 42 are almost on the same level as the cassette 28 only a minimal moment is created. The effect is similar to trying to push a box along the floor, it is easiest to get down on the floor and push the box at floor level. This puts the "push force" closest to the floor and reduces both the effort as well as the tendency for the box to tip. In the present invention, the "box" (carriage 40) is hung from support 26 and the handles 42 that apply the force do so from approximately the same level as the support 26. Large loads are easily moved and Applicant has determined that movement of comparable weights require 3-5 pounds of force in the prior art systems but only 2-4 ounces of force in the present invention. This is sixteen times less than the force required by prior art devices. Thus, it is easier to work with for long periods of time. Again, while the higher forces and moments in other devices tend to tire the operator and cause the shoulders to ache, the present invention add hours of enjoyable pain free quilting to the operator's experience rendering superior ergonomics.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a quilting system, a support and cassette comprising:

a. an elevated monorail support;

b. a cassette movably connected with said elevated monorail support wherein said cassette captures said elevated monorail support within said cassette wherein said cassette includes vertical rollers and horizontal rollers and wherein said monorail support includes at least one rail captured by said cassette; and c. a carriage movably attached to said cassette.

2. The apparatus of claim 1 wherein at least one handle is attached to said cassette approximately even with said elevated monorail support.

3. The apparatus of claim 1 further including a pattern table attached approximately even with said elevated monorail support.

4. The apparatus of claim 3 wherein said pattern table includes a pattern guide for tracing a pattern on said pattern table.

5. The apparatus of claim 1 wherein said pattern guide is selected from a group comprising: a computer graphic, a LED light and a laser light.

6. The apparatus of claim 1 wherein said carriage supports a sewing device from below the sewing device.

7. The apparatus of claim 1 wherein said carriage supports a sewing device from above the sewing device.

8. In a quilting system including a monorail and a cassette, a method for quilting comprising:

a. providing a quilting system with a monorail support with a cassette movably connected with said monorail support wherein said cassette captures said monorail support within said cassette wherein said cassette includes vertical rollers and horizontal rollers, with a carriage movably attached to said cassette and with a sewing device attached to said carriage;

b. inserting material to be quilted into said quilting system; and c. manipulating said carriage and operating said sewing device so as to create a quilting from said quilting material.

9. The method of claim 8 further including the step of attaching a pattern table approximately even with said support and placing a pattern on said pattern table and tracing said pattern by moving said carriage so as to follow said pattern.

10. In a quilting system, a support and cassette apparatus comprising:

a. an elevated monorail support;

b. a cassette movably connected with said elevated monorail support wherein said cassette captures said elevated monorail support within said cassette;

c. a carriage movably attached to said cassette; and d. a pattern table attached approximately even with said elevated monorail support.

11. The apparatus of claim 10 wherein said pattern table includes a pattern guide for tracing a pattern on said pattern table.

12. The apparatus of claim 10 wherein said carriage supports a sewing device from below the sewing device.

13. The apparatus of claim 10 wherein said carriage supports a sewing device from above the sewing device.

14. In a quilting system, a support and cassette apparatus comprising:

a. an elevated monorail support;

b. a cassette movably connected with said elevated monorail support wherein said cassette captures said elevated monorail support within said cassette and wherein said monorail support includes at least one rail captured by said cassette;

c. a carriage movably attached to said cassette; and d. a pattern table attached approximately even with said elevated monorail support.

15. The apparatus of claim 14 wherein said pattern table includes a pattern guide for tracing a pattern on said pattern table.

16. In a quilting system, a support and cassette apparatus comprising:

a. an elevated monorail support;

b. a cassette movably connected with said elevated monorail support wherein said cassette captures said elevated monorail support within said cassette and wherein said monorail support includes at least one rail captured by said cassette; and c. a carriage movably attached to said cassette wherein said carriage supports a sewing device from below the sewing device.

17. The apparatus of claim 16 wherein said carriage supports a sewing device from above the sewing device.

18. The apparatus of claim 16 further including a pattern table attached approximately even with said elevated monorail support.

19. In a quilting system, a support and cassette apparatus comprising:

a. an elevated monorail support;

b. a cassette movably connected with said elevated monorail support wherein said cassette captures said elevated monorail support within said cassette and wherein said monorail support includes at least one rail captured by said cassette; and c. a carriage movably attached to said cassette wherein said carriage supports a sewing device from above the sewing device.

20. The apparatus of claim 19 further including a pattern table attached approximately even with said elevated monorail support.

* * * * *